US005259199A

United States Patent [19]

Franklin

[11] Patent Number: 5,259,199

[45] Date of Patent: Nov. 9, 1993

[54] COLD PLATE/TANK WITH REMOVABLE $CO_2$ INJECTION UNIT

[76] Inventor: Paul R. Franklin, 5211 W. Beaver St., Jacksonville, Fla. 32205

[21] Appl. No.: 911,098

[22] Filed: Jul. 9, 1992

[51] Int. Cl.[5] ..... F25J 1/00

[52] U.S. Cl. ..... 62/10; 62/384

[58] Field of Search ..... 62/10, 12, 384; 261/DIG. 7

[56] References Cited

U.S. PATENT DOCUMENTS

| | | | |
|---|---|---|---|
| 1,712,701 | 5/1929 | Hassensall | 62/384 |
| 2,759,336 | 8/1956 | Seefeldt | 62/303 |
| 3,373,581 | 3/1968 | Strader | 62/384 |
| 3,670,522 | 6/1972 | Bresin | 62/333 |
| 3,871,107 | 3/1975 | Broadwin | 62/384 |
| 4,022,119 | 5/1977 | Karr | 99/275 |
| 4,094,164 | 6/1978 | Cope | 62/74 |
| 4,393,660 | 7/1978 | Kleiner et al. | 261/DIG. 7 |
| 4,404,818 | 9/1983 | Franklin, Jr. | 62/384 |
| 4,502,293 | 3/1985 | Franklin, Jr. | 62/388 |
| 4,593,536 | 6/1986 | Fink et al. | 62/384 |
| 4,766,732 | 8/1988 | Rubin | 62/62 |
| 4,848,095 | 7/1989 | Franklin | 62/121 |
| 4,924,935 | 5/1990 | Van Winckel | 165/10 |
| 5,092,133 | 3/1992 | Franklin | 62/59 |

*Primary Examiner*—Ronald C. Capossela

*Attorney, Agent, or Firm*—Jacobson, Price, Holman & Stern

[57] ABSTRACT

An open top tank is provided for containing a chilling liquid therein to a predetermined level together with a $CO_2$ injection structure downwardly removably receivable within the tank in a manner substantially fully closing the upper end of the tank and the $CO_2$ injection structure defines an upwardly opening central duct within the tank opening at its bottom to the interior of the tank. The upper end of the duct opens into a downwardly opening housing supported from the upper end of the duct and the housing includes a downwardly opening portion thereof spaced laterally outwardly of at least one side of the duct. The $CO_2$ injection structure includes an upwardly directed $CO_2$ orifice disposed within the lower end portion of the duct spaced below the aforementioned predetermined level and the upward discharge of $CO_2$ under pressure within the duct causes an upward flow of chilling liquid within the duct, a downward flow of chilled chilling liquid from the laterally outwardly projecting portion of the housing and the entrance of chilling liquid into the bottom of the duct from the lower end portion of the tank disposed below the aforementioned predetermined level.

12 Claims, 1 Drawing Sheet

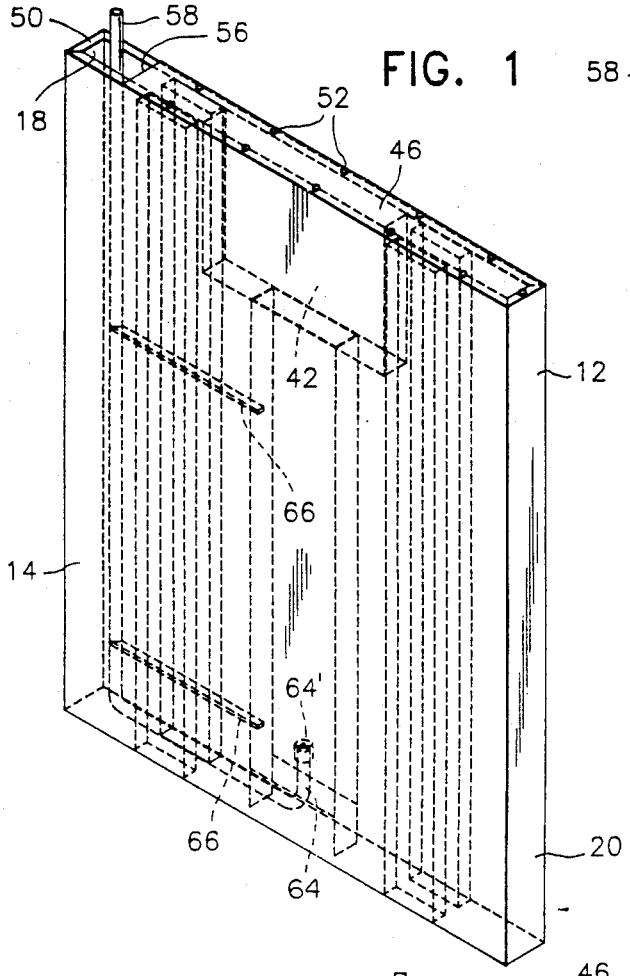
FIG. 1
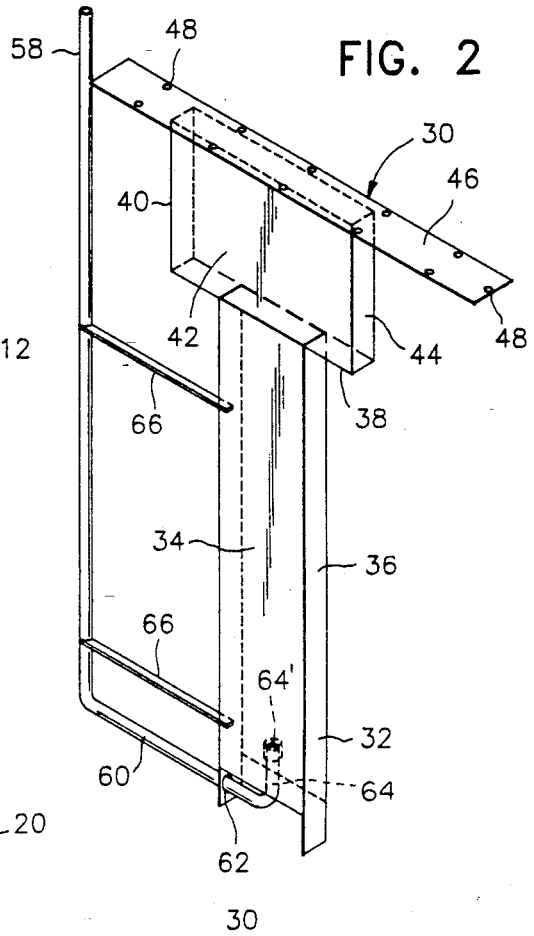
FIG. 2
FIG. 3
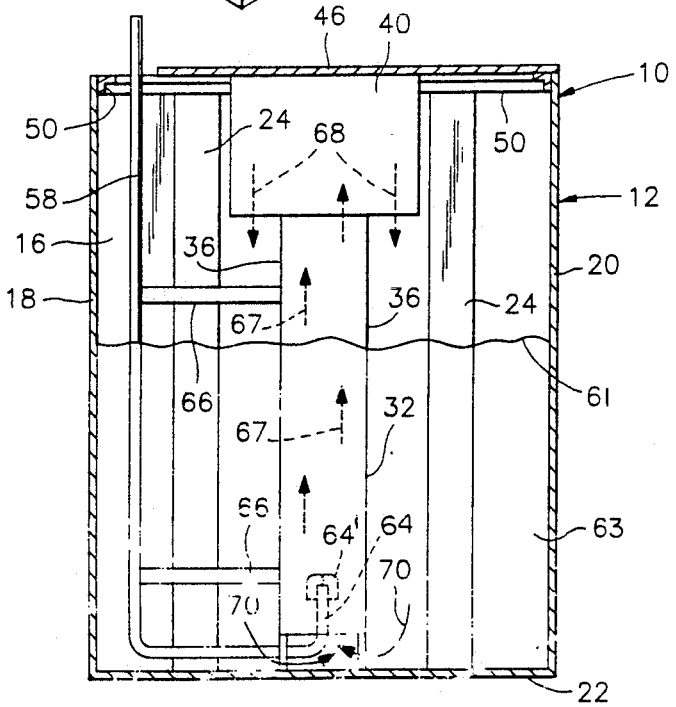

COLD PLATE/TANK WITH REMOVABLE $CO_2$ INJECTION UNIT

BACKGROUND OF THE INVENTION

1. Field of The Invention

This invention relates to a cold plate consisting of an exterior tank and a removable inner $CO_2$ charging unit which enables quick charging of the cold plate. The removability of the $CO_2$ charging unit from the tank section enables the entire cold plate to be readily mass produced.

2. Description of Related Art

Various different forms of cold plates heretofore have been provided, but most occupy a great amount of space and require a considerable length of time to charge.

SUMMARY OF THE INVENTION

The cold plate of the instant invention incorporates an open top tank and a removable charging unit downwardly insertable within the tank and including an upper plate which closes the open upper end of the tank except for an access opening serving as an entrance-way for a $CO_2$ supply line and a $CO_2$ vapor vent opening.

By constructing the cold plate of these two removably joinable components, the cold plate may be more readily produced on an assembly line basis and, further, may be more readily serviced.

Also, if a plurality of cold plates are to be used in an enclosure such as a truck body, the $CO_2$ supply lines for the various cold plates utilized may open into a manifold line and the manifold line may open to the exterior of the truck body. Further, all of the vapor outlets may open into a ventilation manifold also opening to the exterior of the truck body. In this manner, all of the cold plates may be simultaneously charged and the interior of the associated truck body does not experience a build-up of $CO_2$ gas, therefore enabling the truck body to transport eggs.

In addition to the above, the charging unit of the cold plate is designed in a manner such that better than 90 percent of water used a chilling liquid may be transformed into ice and if a eutectic solution is used as a chilling liquid all of the eutectic solution can be frozen except for the added ethylene glycol or other similar liquid.

Still further, because of the construction of the charging unit of the cold plate and the manner in which a plurality of cold plates within a truck body may be simultaneously charged, all of the cold plates within a truck body may be charged in approximately 4 to 8 minutes if water is used as the chilling fluid or in approximately 4 to 10 minutes if a eutectic solution is used as the chilling liquid. With this type of quick charging, the cold plates within a truck or trailer body may be charged within approximately 10 minutes instead of as much as 8 to 10 hours and, therefore, a single truck may be used throughout two shifts daily instead of only one shift. Thus, the number of trucks required for deliveries can be cut by substantially one-half and, of course, the attendant expenses in connection operation of trucks (maintenance, insurance and depreciation) also are reduced by substantially one-half.

The main object of this invention is to provide a cold plate which may be economically produced by assembly line methods, which may be quickly charged and which may be used with water or a eutectic solution as the chilling liquid therein.

Another object of this invention is to provide a cold plate which is quite narrow and rugged and which therefore may be used to great advantage in confined areas such as truck bodies.

Another important object of this invention is to provide a cold plate which may be connected in tandem with other cold plates within the same truck body or other enclosure and which therefore enable a plurality of cold plates to be simultaneously charged.

A further object of this invention is to provide a cold plate which may be charged in a minimum amount of time.

A still further object of this invention is to provide a cold plate which may be used in tandem with other cold plates and which may be readily vented to the exterior of an associated truck body.

A final object of this invention to be specifically enumerated herein is to provide a cold plate in accordance with the preceding objects and which will conform to conventional forms of manufacture, be of simple construction and easy to use so as to provide a device that will economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a perspective view of a cold plate constructed in accordance with the present invention;

FIG. 2 is a perspective view of the removable $CO_2$ charging unit of the cold plate; and FIG. 3 is a vertical sectional view of the cold plate.

DESCRIPTION OF THE PREFERRED EMBODIMENT

Referring now more specifically to the drawings the numeral 10 generally designates a cold plate constructed in accordance with the present invention. The cold plate 10 includes an open top tank 12 including front and rear walls 14 and 16, opposite end walls 18 and 20 and a bottom wall 22 extending between and interconnecting the walls 14, 16, 18 and 20.

Each of the front and rear walls 14 and 16 is reinforced by a vertical channel member 24 extending therealong and secured thereto throughout substantially the full height of the corresponding wall and it is to be noted that the tank 10 as well as the channel members 24 will be constructed of suitable gauge stainless steel.

With reference now more specifically to FIG. 2 of the drawings, there may be seen a $CO_2$ charging unit referred to in general by the reference numeral 30. The unit 30 includes an upstanding central duct 32 including opposite front and rear walls 34 and opposite end walls 36. The upper end of the duct 32 opens upwardly into the open lower end 38 of a downwardly opening housing 40 including opposite front and rear walls 42 and opposite end walls 44. The upper end of the housing 40 is closed by a top plate 46 secured thereover in any convenient manner and of greater width and length than the housing 40, the opposite side margins and one end margin of the top plate 46 being provided with apertures 48 spaced therealong.

The upper end of the tank 12 is braced by peripherally extending angle members 50 whose vertical flanges are secured to the inner surfaces of the walls 14, 16, 18 and 20 and whose horizontal flanges project inwardly therefrom and are equipped with apertures 52 therethrough with which the apertures 48, are registerable. Accordingly, the top plate 46 may be supported from and secured to the horizontal flanges of the angle members 50 through the utilization of self threading fasteners (not shown) passed through the apertures 48 and secured in the apertures 52.

From FIG. 1 of the drawings it will be noted that the top plate terminates a spaced distance f rom the end wall 18 in order to define an access opening 56 opening downwardly into the tank 12, the access opening 56 serving as a passageway to be referred to hereinafter as well as a vent opening.

The charging unit 30 also includes a pressurized $CO_2$ supply line 58 which extends downwardly along the housing 40 and the duct 36. The lower end of the supply line 58 includes an inwardly directed horizontal component 60 which extends through an opening 62 provided therefore in the lower end of the end wall 30 opposing the supply line or pipe 58 and the horizontal component terminates at its end remote from the vertical portion of the supply line 58 in an upwardly directed segment 64.

The front and rear walls 34 of the duct 32 terminate downwardly a spaced distance above the lower ends of the end walls 36 and the horizontal-component 60. Thus, the lower end of the duct 32 opens outwardly both forwardly and rearwardly within the lower part of the tank 12.

Vertically spaced portions of the supply line 58 are braced relative to the adjacent end wall 36 of the duct 32 through the utilization of a pair of horizontal braces 66 and, thus, all of the components of the charging unit 30 illustrated in FIG. 2 are joined together as a single unit which may be manufactured on an assembly line separate from an assembly line producing the tank 12.

Assembly of the unit 30 and the tank 12 is quite easy in that the unit 30 is lowered downwardly into the tank 12 until the top panel or wall 46 abuts and is supported from the horizontal flanges of the angle members 50. Then, self threading fasteners may be used to secure the top plate or wall 46 to the upper end of the tank 12.

After the cold plate 10 has been assembled, it may be installed within a truck body or the like in conjunction with other cold plates of similar construction. The supply lines 58 for the units 30 may have their inlet ends sealingly communicated with a supply manifold and the supply manifold may have an inlet therefore opening outwardly of the associated truck body. In addition, the access openings 50 all may be communicated with a main ventilation duct through the utilization of suitable duct work and such main ventilation duct also may open outwardly of the associated truck body. In this manner, the cold plates 10 (connected in tandem) may be simultaneously charged and subsequently used Without any $CO_2$ gas accumulating in the associated truck body.

With attention now invited more specifically to FIG. 3, it may be seen that the tank 12 of the cold plate 10 is filled to a predetermined level 60 with a suitable chilling liquid 62 (either water or a eutectic solution having ethylene glycol or a similar liquid thereto). When it is desired to charge the cold plate 10, liquid $CO_2$ is supplied to the supply line 58 and discharged therefrom through a discharge orifice cap 64' carried by the upwardly directed outlet end of the supply line 58. This liquid $CO_{CO2}$, being discharged under relatively high pressure, creates a venturi action as well as a pressure action upon the chilling liquid 62 within the duct 32 driving the chilling liquid 62 upwardly through the duct 32 as indicated by the arrows 67 and into the lower end of the housing 40. The upwardly moving chilling liquid 62 then impacts with the underside of the top plate 46 closing the upper end of the housing 40 and falls back downwardly and outwardly of the open bottom of the housing 40 outwardly of the end walls 36 thereof as indicated by the arrows 68. Of course, as chilling liquid 62 moves upwardly through the duct 32 as indicated by the arrow 66, replacement chilling liquid 62 enters the lower end of the duct 32 as indicated by the arrows 70. Thus, the discharge of liquid $CO_2$ from the cap 64' creates a circulatory movement of the chilling liquid 62 within the tank 12 and through the chilling unit 30. This discharge of liquid $CO_2$ is continued until approximately 90 percent of the water used as a chilling liquid is frozen, or until all of the eutectic solution, except for the ethylene glycol added thereto, is frozen.

It is also pointed out that all of the components which comprise the charging unit 30 are constructed of stainless steel. Thus, the cold plate 10 is substantially maintenance free and may be repeatedly used over a extended period time.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cold plate including a removable $CO_2$ injection unit, said cold plate including an upwardly opening tank containing a chilling liquid therein to a predetermined level, a $CO_2$ injection structure supported within said tank defining an upstanding duct including a lower end opening into said tank below said predetermined level and an upper end opening upwardly into a downwardly opening housing mounted within said tank above said predetermined level, said housing including at least one portion thereof projecting laterally outwardly beyond said upper end and opening downwardly within said tank toward said predetermine level, and pressurized $CO_2$ operative to upwardly discharge $CO_2$ under pressure into said duct lower end at a second level spaced below said predetermined level.

2. The cold plate of claim 1 wherein said second level is spaced above said lower end.

3. The cold plate of claim 1 wherein said pressurized $CO_2$ injection means comprises liquid $CO_2$ injection means.

4. The cold plate of claim 1 wherein said $CO_2$ injection unit is removably supported from said tank.

5. The cold plate of claim 4 wherein said $CO_2$ injection unit includes an upper plate portion which substantially closes the open upper end of said tank.

6. The cold plate of claim 1 wherein said chilling liquid comprises a eutectic solution.

7. The cold plate of claim 1 wherein said duct, housing and $CO_2$ injection means are joined together to form a single unit and said unit is removably supported from said tank.

8. The cold plate of claim 7 wherein said unit includes an upper plate portion which substantially closes the open upper end of said tank.

9. The cold plate of claim 8 wherein said upper plate portion defines a vapor vent for venting $CO_2$ gas from the upper portion of said.

10. The cold plate of claim 9 wherein said $CO_2$ injection means includes a supply pipe for $CO_2$ under pressure extending through said vapor vent.

11. The cold plate of claim 1 wherein said upper end of said charging unit includes a top plate mounted therefrom and lapped over and at least substantially closing the open upper end of said tank, said top plate including a marginal portion thereof terminating a spaced distance inward from the corresponding marginal portion of said open upper end of said tank defining an access opening, horizontally offset from said duct open end, opening into said tank past said top plate, said charging unit including a $CO_2$ supply line extending through said access opening and said access opening defining a vent for $CO_2$ gas to escape from within said tank.

12. The method of rapidly and uniformingly lowering the temperature of a chilling liquid disposed within an upwardly opening cold plate tank to a predetermined level therein, said method including providing an upstanding duct within said tank with the lower end of said duct opening into said tank below said level and the upper end of said duct opening upwardly into a downwardly opening housing disposed within said tank above said level and including a portion thereof spaced laterally outwardly of said duct opening downwardly toward said level, and upwardly injecting $CO_2$ under pressure into said duct lower end at a second level spaced below said predetermined level.

* * * * *